US005558243A

United States Patent [19]

Chu

[11] Patent Number: 5,558,243

[45] Date of Patent: Sep. 24, 1996

[54] SEALING CAP FOR VACUUM CONTAINERS

[75] Inventor: Hui-Ying Chu, Tainan Hsien, Taiwan

[73] Assignee: Chiun Pao Enterprise Co., Ltd., Tainan Hsien, Taiwan

[21] Appl. No.: 336,739

[22] Filed: Nov. 7, 1994

[51] Int. Cl.[6] ..... B65D 31/04

[52] U.S. Cl. ..... 220/212; 220/240; 215/228; 215/262; 215/270

[58] Field of Search ..... 220/212, 231, 220/240, 203.11, 203.23, 203.27, 203.28, 203.29, 367.1, 374; 215/228, 260, 262, 270, 311, 315

[56] References Cited

U.S. PATENT DOCUMENTS

| | | | |
|---|---|---|---|
| 3,313,444 | 4/1967 | Katell | 220/231 X |
| 3,602,387 | 8/1971 | Patnaude | 215/228 X |
| 5,347,918 | 9/1994 | Chen | 220/231 X |
| 5,364,241 | 11/1994 | Schultz | 220/203.11 |
| 5,390,809 | 2/1995 | Lin | 220/212 |
| 5,406,992 | 4/1995 | Miramon | 141/65 |
| 5,469,979 | 11/1995 | Chiou | 215/228 |

*Primary Examiner*—Stephen K. Cronin
*Attorney, Agent, or Firm*—Morton J. Rosenberg; David I. Klein

[57] ABSTRACT

A sealing cap for coupling with an upper edge of a container includes a base disc, a spiral spring, a sucking plate and a soft cap body combined together. The soft cap body is able to be pressed down manually and pushed up by the spring and the sucking plate, to force air from the container to flow out of a hole in the outer circumference of the base disc. The air in the container flows through a stop valve, formed in the bottom center of the base disc, into the space between the base disc and the soft cap body. The air is stopped by a leak valve fixed in the outer circumference of the base disc. A repeated pressing action on the soft cap body is capable of displacing sufficient air from the container to create a partial vacuum therein.

3 Claims, 5 Drawing Sheets

SEALING CAP FOR VACUUM CONTAINERS

BACKGROUND OF THE INVENTION

This invention concerns a sealing cap for vacuum containers. Particularly, this invention is directed to a vacuum container having an elastic sucking plate that is repeatedly pressed down to pump out air from a container, which will be evacuated without using an air pump.

There is a known conventional vacuum container shown in FIG. 6 including a container 1, a cap 11, a stop valve 12, and a leak valve 13 provided on the cap 11. An air pump 14 is placed on the cap for pumping out the air from the container 1 when it is desired to preserve food stored in the container for a long period of time.

However, this conventional vacuum container has disadvantages in practical use as follows:

1. The air pump and the container are independent units, so that when the container is to store food and is to be pumped out, the air pump has to be found. If the air pump should be lost, the container becomes a common one, unable to preserve food in a vacuum.

2. The air pump has to be placed just on the stop valve of the cap, and must be pulled up and pushed downwith a comparatively large force. During the pumping operation the air pump may sway, and even worse, may separate from the stop valve. Then, the air pump must be repositioned. Additionally, the pumping capacity of the air pump is limited, with pulling and pushing force required being larger and larger as the degree of vacuum within the container becomes greater.

3. The leak valve consists of a small stopper and a leak hole for receiving the stopper therein. That arrangement is not convenient nor practical to use, and the stopper is likely to drop off.

SUMMARY OF THE INVENTION

The purpose of this invention is to offer a sealing cap that is capable of being pressed down to gradually and easily pump air from a container by means of a sucking plate, a spring, and a stop valve, to provide a partial vacuum within the container. Therefore, an air pump is never necessary for pumping air out with the sealing cap of the present invention.

BRIEF DESCRIPTION OF THE DRAWINGS

The invention will be better understood by reference to the accompanying drawings, wherein.

DESCRIPTION OF THE PREFERRED EMBODIMENTS

Figure 1:
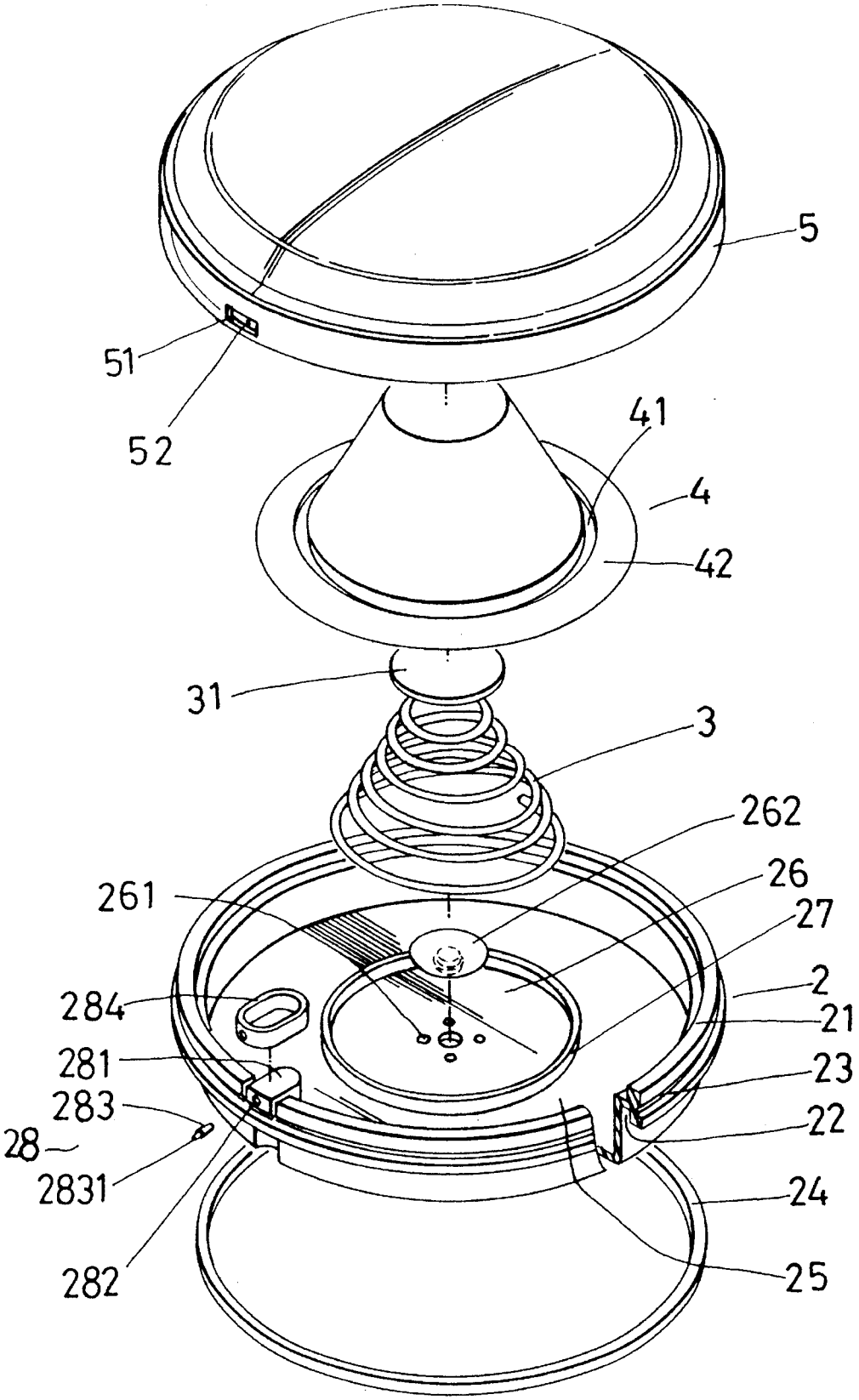
FIG. 1 is an exploded perspective view of a sealing cap for vacuum containers of the present invention.

A sealing cap for a vacuum container, as shown in FIG. 1, includes a base disc 2, a spiral spring 3, a sucking plate 4 and a soft cap body 5, as the main components that are combined together.

The base disc 2 has an outer circumference 21 provided with a bottom annular groove 22 and a side annular groove 23. A seal ring 24 is received within the bottom annular groove 22, the side annular groove 23 receives an inner annular ridge 51 of the soft cap body 5 therein. The base disc 2 has a flat bottom 25 with a stop valve 26. The stop valve 26 consists of a plurality of holes 261 formed in the center portion of the bottom 25 and a film 262 resting on the holes 261. A ring 27 is formed on the bottom 25 around the stop valve 26. A leak valve 28 is fixed at some location on the outer circumference 21 of base disc 2.

The leak valve 28 has a valve base 281 having a leak hole 282 formed therein. A stopper 283 fits into the leak hole 282, and a ring 284 fits around the valve base 281 for securing the stopper 283 in place.

The spiral spring 3 is spirally shaped to correspond to the underside of the sucking plate 4. The bottom end of spring 3 is disposed on the flat bottom 25 of the base disc 2 within the ring 27, and a plate 31 is provided to sit on top of the spring 3.

The sucking plate 4 is made of rubber and shaped as a cone, covering the spring 3 and having a lower annular groove 41 for defining a circumferential edge to engage the ring 27. An outer annular flat portion 42 extends outwardly from the groove 41 to contiguously rest on the bottom 25 of the base disc 2.

The soft cap body 5 is made of rubber, having an annular ridge 51 on its inner circumference, and a hole 52 formed through an outer circumference. The annular ridge 51 fits into the side annular groove 23 of the base disc 2 for securing the cap body 5 to the base disc 2.

Figure 2:
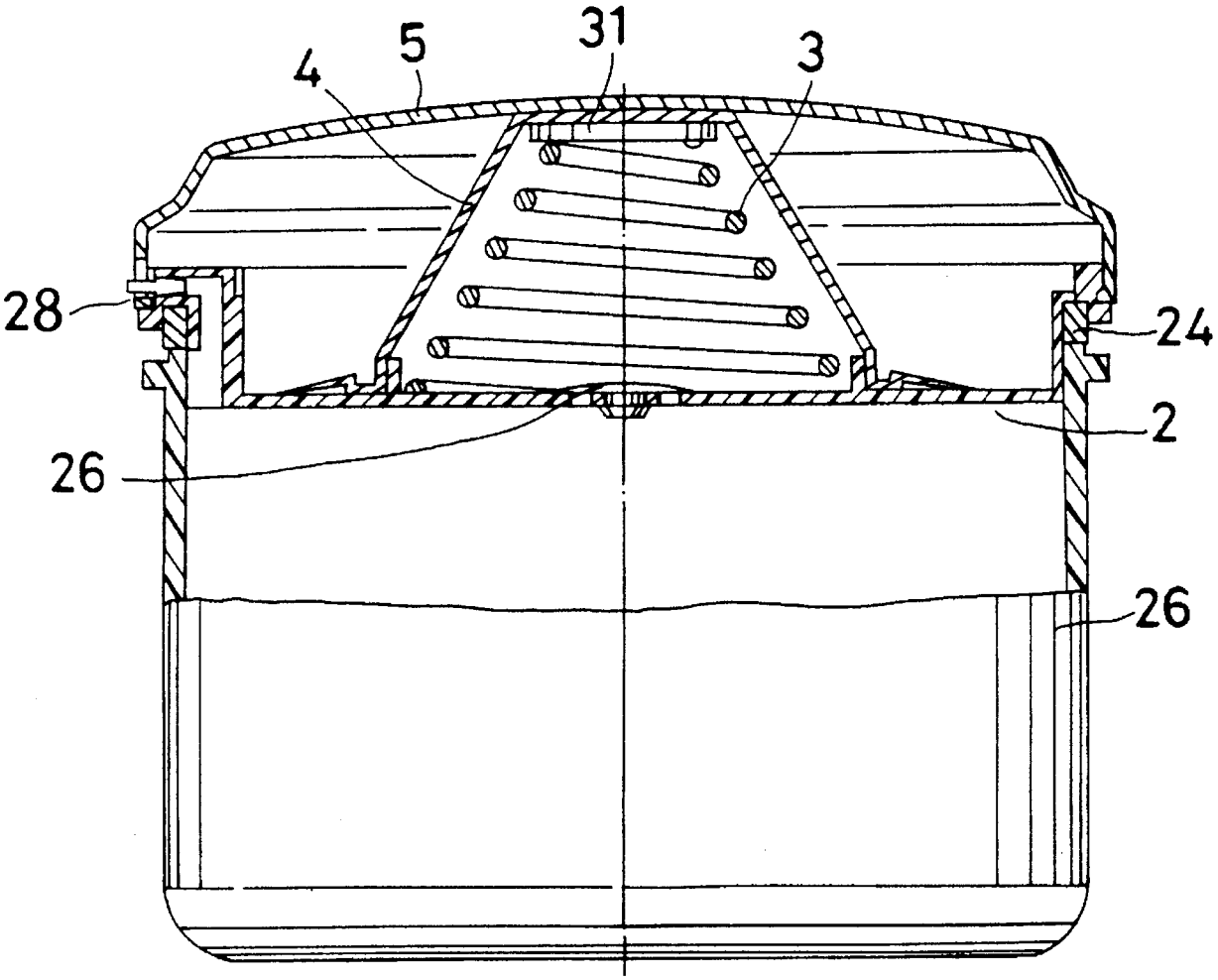
FIG. 2 is a cross-sectional elevation view of the sealing cap positioned on a vacuum container.
Figure 3:
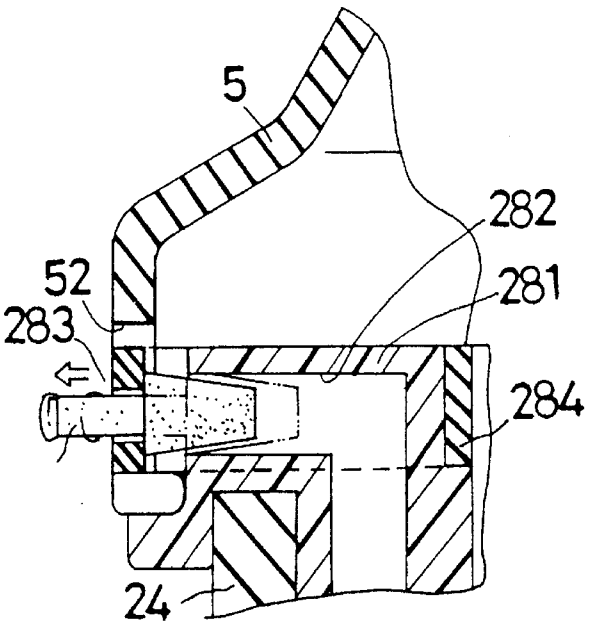
FIG. 3 is a cross-sectional view of a leak valve in the sealing cap for vacuum containers of the present invention.

In assembling the container, as shown in FIG. 2, first the seal ring 24 is made to fit around the bottom annular groove 22 of the base disc 2, and the film 262 is placed on the holes 261 in the flat bottom 25 for forming the stop valve 26. Then the stopper 283 is inserted into the leak hole 282 of the valve base 281, and the ring 284 is placed around the valve base 281. The ring 284 prevents the stopper 283 from loosening from the leak hole 282 and lets an outer pulling portion 2831 of the stopper 283 be exposed through the ring 284, as shown in FIG. 3. Then the spiral spring 3 and the sucking plate 4 are placed on the bottom 25 within the ring 27. Finally, the cap body 5 is made to cover the base disc 2, with the inner ridge 51 fitting firmly in the side annular groove 23 of the base disc 2, and with the stopper 283 of the leak valve 28 protruding, a little, through the hole 52 of the cap body 5.

Figure 5:
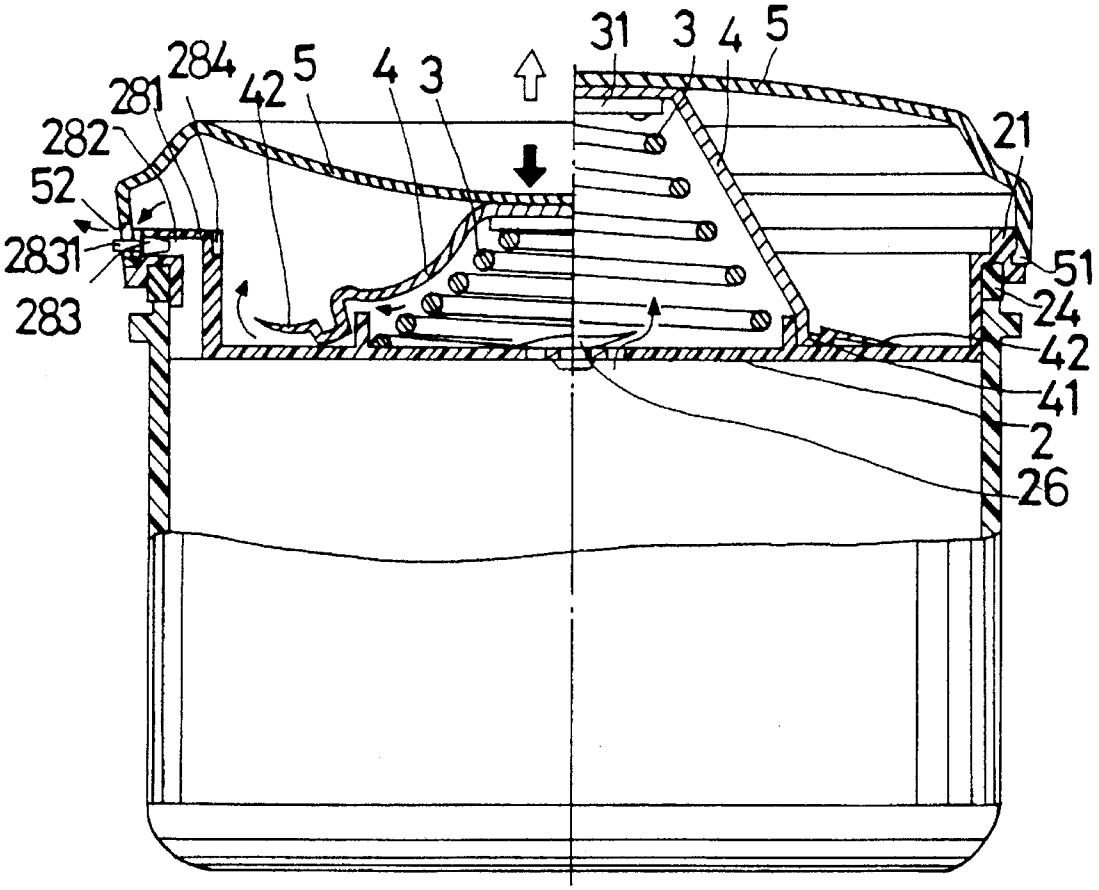
FIG. 5 is a cross-sectional view of the sealing cap for vacuum containers of the present invention, showing the cap being pressed down; and, FIG. 6 is an elevation view of a known conventional vacuum container.
Figure 4:
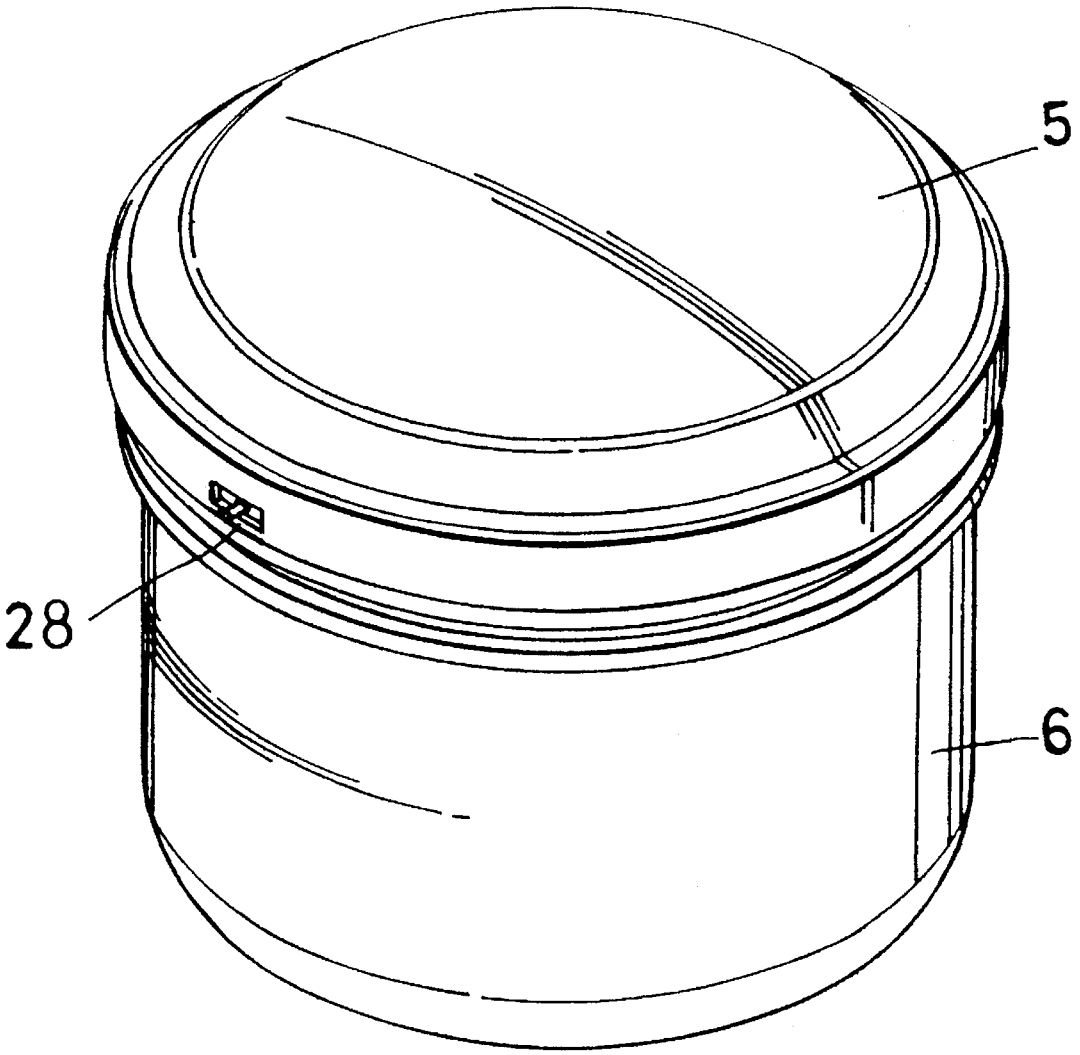
FIG. 4 is a perspective view of the sealing cap of the present invention.
Figure 6:
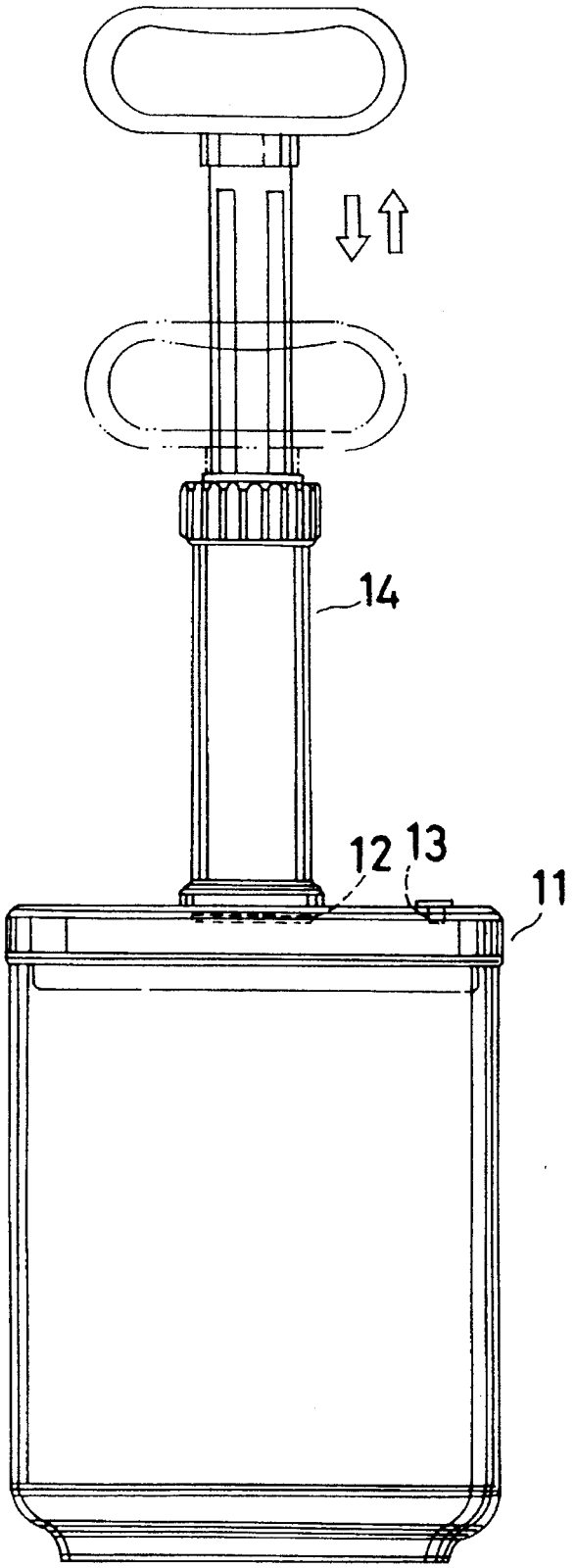
FIG. 6 (PRIOR ART)

The method of operating this sealing cap is shown in FIGS. 4 and 5, the sealing cap having been placed on a container 6 with the seal ring 24 around the upper edge thereof. After food or the like is put in the container 6, and it is desired to pump out the air therein, the cap body 5 is manually pressed down at the center portion. Such displacement of the cap body forces the air in the sucking plate 4 to flow out through the hole 52 of the cover 5. Then, if the cover 5 is released, the sucking plate 4 is elastically pushed up by the spiral spring 3. That action forces the air in the container 6 to flow up through the holes 261 into the space in the sealing cap. Repeated pressing of the cap body 5 can force out almost all of the air in the container 6. The spring 3 functions with enough elasticity for smooth pumping out the air, without the difficulty that is involved in conventional pumps used with vacuum containers, where the degree of difficulty gets larger and larger. Further, a pressing action is far easier than that of the conventional pump. It is advantageous that the spiral spring 3 functions to support the sucking plate 4, permitting the plate 4 to always have its original air displacement capacity. The larger the degree of vacuum within the container, the tighter the outer annular portion 42 of the sucking plate 4 becomes with respect to bottom 25 of base 2, but air exhausting is quite smooth, which is a great advantage of this sealing cap.

When the container 6 is in an evacuated condition, and it is desired to let air flow therein for opening the sealing cap, the pulling portion 2831 of the stopper 283 of the leak valve 28 is manually pulled out. That action permits ambient air to flow through the gap, between the stopper 283 and the leak hole 282 into the container 6. Under normal conditions, the stopper 283 completely blocks the leak hole 282. In addition, the stopper 283 is restricted by the ring 284, never falling from the leak hole 282, which is another advantage of this sealing cap.

As can be understood from the above description, this invention has the following advantages:

1. It provides a pumping function with a simple structure, with no need for an air pump, making it very convenient.

2. Its operation is simple, requiring only the pressing of the cap body for pumping air from a container, with the aid of a spiral spring having enough elasticity to return the cap body to its original condition without using any additional manual force. Such an arrangement is an improvement over known conventional pumps for vacuum containers.

3. Its leak valve is firmly secured, having a stopper tightly blocking the leak hole and restricted by a ring, permitting an easy pumping air action, but making it hard to loosen and fall off.

4. It is of a light weight, has a flat contour, provides excellent pumping action, and has a good looking appearance.

While the preferred embodiments of the invention have been described above, it will be recognized and understood that various modifications may be made thereto, and the appended claims are intended to cover all such modifications which may fall within the spirit and scope of the invention.

What is claimed is:

1. A sealing cap for vacuum containers, comprising:

a base disc having an outer circumferential edge portion with a first annular groove formed in a lower surface thereof for coupling to a container and a second annular groove formed in an outer perimeter surface of said outer circumferential edge portion, said base disc including (1) a centrally disposed stop valve, (2) a raised ring formed on a bottom surface of said base disc and circumscribing said stop valve, and (3) a leak valve secured to said outer circumferential edge portion;

a spring having opposing first and second ends, said first end of said spring being disposed on said bottom surface of said base disc within said raised ring;

a plate member disposed on said second end of said spring;

a sucking plate formed of a rubber material and having a central conically shaped portion overlaying said spring and plate member, said central conically shaped portion extending from a circumferential annular flat portion disposed on said bottom surface of said base disc circumscribing said raised ring;

a soft cap body coupled to said base disc and overlaying said sucking plate, said cap body being formed of a rubber-like material and having an inner annular ridge adapted to engage said second annular groove of said base disc, wherein positioning said sealing cap on an upper edge of a container and repeatedly displacing a portion of said cap body against said spring pumps air from the container to form a partial vacuum therein.

2. The sealing cap as recited in claim 1 where said leak valve includes:

a valve base secured to an upper portion said outer circumferential edge portion of said base disc, said valve base having a leak hole formed therethrough for passage of air to and from the container;

a stopper displaceably disposed within said leak hole for blocking and unblocking passage of air therethrough; and, a ring member positioned around said valve base and adapted to retain said stopper in proximity to said leak hole.

3. The sealing cap as recited in claim 1 where said spring has a spiral shape for supporting said sucking plate to maintain an air displacement capacity thereof.

* * * * *